US005156581A

United States Patent [19]

Chow

[11] Patent Number: 5,156,581

[45] Date of Patent: Oct. 20, 1992

[54] FINGER CONDITIONING DEVICE

[76] Inventor: John W. Chow, 353 Hawkeye Ct., Iowa City, Iowa 52246

[21] Appl. No.: 718,950

[22] Filed: Jun. 21, 1991

[51] Int. Cl.[5] ..... A63B 23/16; A63B 21/062

[52] U.S. Cl. ..... 482/47; 482/99; 482/101

[58] Field of Search ..... 128/25 R, 26; 272/116-118; 482/44, 47, 92-94, 99, 101

[56] References Cited

U.S. PATENT DOCUMENTS

| | | |
|---|---|---|
| 2,476,518 | 7/1949 | Underwood . |
| 3,347,547 | 10/1967 | Hynes . |
| 3,871,646 | 3/1975 | Slack . |
| 4,357,010 | 11/1982 | Telle . |
| 4,368,883 | 1/1983 | Tiktin . |
| 4,426,077 | 1/1984 | Becker . |
| 4,455,019 | 6/1984 | Harris . |
| 4,546,971 | 10/1985 | Raasoch . |
| 4,577,861 | 3/1986 | Bangerter et al. . |
| 4,669,724 | 6/1987 | Matheisen . |

FOREIGN PATENT DOCUMENTS 0132162 4/1984 European Pat. Off. .

*Primary Examiner*—Robert Bahr
*Assistant Examiner*—Linda C. M. Dvorak
*Attorney, Agent, or Firm*—James C. Nemmers

[57] ABSTRACT

A finger exercise device which allows a user to move his/her fingers against resistance while allowing the user to perform different types of finger movement, such as flexion, extension, abduction, adduction, etc. The device also provides a finger exerciser that will allow the user to exercise an individual finger or a combination of fingers and which will allow the user to select the degree of resistance placed on the finger movement. By use of a pulley system that provides for even distribution of load on active fingers, and a weight unit that provides variable resistance, finger exercise is performed by placing fingertips in finger rests located in slots and moving the fingertips outwardly or inwardly against the resistance of the weight unit.

6 Claims, 6 Drawing Sheets

FINGER CONDITIONING DEVICE

BACKGROUND OF THE INVENTION

1. Field of the Invention

The present invention relates to strength training devices, specifically to such training devices which are used for strengthening muscles and connective tissues that affect the movement of fingers.

2. Description of Prior Art

Strength training for improving the functional capacity of muscles and tendons is popular among athletes, fitness enthusiasts, and patients recovering from injury, illness or surgery. Various types of strength training and conditioning devices and equipment are commercially available and used to strengthen and condition different parts of the body. However, very few devices are designed for the strengthening and conditioning of the muscles that control finger movement. The strengthening and conditioning of fingers has been overlooked as evidenced by the lack of any mention of such training in most textbooks on strength training. Moreover, finger strengthening and conditioning is rarely included in the strength programs of those sports that require manipulating objects with the hands, such as basketball, volleyball, shot-putting, etc. Certainly, the lack of adequate training equipment for fingers is a major reason why such training has received such little attention.

There are finger exercise devices disclosed in the prior art, but they do not provide any means for the user to employ both flexion and extension exercises of the fingers nor do the prior art devices have any means for varying the amount of resistance to finger movement. As used herein, "flexion" refers to the action of bringing fingers together and "extension" means the reverse of flexion, that is, spreading the fingers out. Some examples of the prior art are briefly described below.

Houle U.S. Pat. No. 3,216,412 discloses a handy finger exercise that is intended to be used by musicians an patients. The device allows the users to exercise their fingers by piano playing-like movement. Minimal resistance is provided. Power supply is needed in order to operate the device.

Bendix U.S. Pat No. 3,216,259 shows a portable therapeutic hand and finger exerciser. This exerciser is merely a modification of the common hand-gripper often found in stores. Resistance is given by helical springs.

Ratchford U.S. Pat. No. 3,570,849 also shows a portable hand and finger exerciser. The function of this exerciser is the same as the hand-gripper except that resistance is provided by rubber bands.

Greer U.S. Pat. No. 4,065,995 describes a pocket finger exercise board. This is also a hand-gripper type of device with limited applications.

Unger U.S. Pat. No. 4,105,200 shows a hand and finger exercise device. The device is cylindrical in shape and is designed to be grasped in the palm of a user. Two elastic flexing straps, one housing the thumb and the other the four fingers, exerts pressure on the fingers of the user when the fingers are moving away from the cylinder. The resistance depends on the elasticity of the straps.

Pasbrig U.S. Pat. No. 4,350,335 illustrates an appliance for use in finger exercise performed by pressing sliding rods that are resisted by springs.

Higami U.S. Pat. No. 4,577,858 shows a fingertip exerciser that is consisted of two rotating deformable balls. The device is suitable for the training of manual capability, not for the training of strength.

Plough U.S. Pat. No. 4,615,522 discloses a therapeutic finger exercise device that is intended to develop manual dexterity of the user. The device is a stiff wire frame for holding two non-adjacent fingers in a substantially fixed position while permitting the other fingers to exercise.

Thomas U.S. Pat. No. 4,657,243 shows a finger exercise device that does not provide resistance to finger movement. The exercise is achieved by maneuvering a captive element slidably mounted on a closed wire loop.

Bonasera U.S. Pat. No. 4,765,608 describes a finger exerciser for guitar players. Resistance is imposed on the fingers when the user's fingers are pressed onto the bar of the guitar.

Stefanski U.S. Pat. No. 4,815,729 shows a glove-like finger exercise device which has an elastic strip built around the outside of the finger pockets. The elastic strip provided resistance when the user exert force against the strip with the fingers.

The foregoing prior art finger exercise devices, though simple and portable, have definite that pertain to the exercise training of fingers. Whatever the merits, features and the advantages of the prior art devices, none of them achieves or fulfills the purposes of the finger conditioning device of the present invention.

SUMMARY OF THE INVENTION

The present invention provides a finger exercise device which allows a user to move his/her fingers against resistance while allowing the user to perform different types of finger movement, such as flexion, extension, abduction, adduction, etc. The device of the invention also provides a finger exerciser with characteristics that will allow the user to exercise an individual finger or a combination of fingers. The invention also provides a finger exercise device with characteristics that will allow the user to select the degree of resistance placed on the finger movement. The finger exercise device of the invention comprises a frame structure providing structural support for an exercise-mode control unit containing the mechanism that allows different types of finger exercise. By use of a pulley system that provides for even distribution of load on active fingers, a weight unit provides variable resistance. By adjusting a knob located at the front panel and inserting a pin into a hole in the load bar of the weight unit, a user can select the type of finger exercise and the degree of resistance on finger movement. Finger exercise is performed by placing fingertips in finger rests located in slots of the circular top plate and moving the fingertips toward or away from the center of the top plate.

Further objects and advantages will become apparent from a consideration of the ensuing description and drawings.

BRIEF DESCRIPTION OF THE DRAWINGS

In the drawings, closely related figures have the same number but different alphabetic suffixes.

DETAILED DESCRIPTION OF THE PREFERRED EMBODIMENT OF THE INVENTION

Figure 1A:
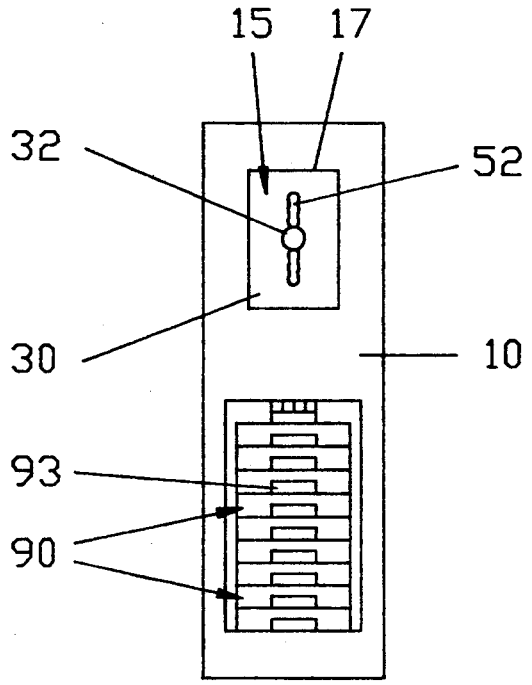
FIG. 1A is a front elevational view showing a device constructed according to the principles of the invention.
Figure 1B:
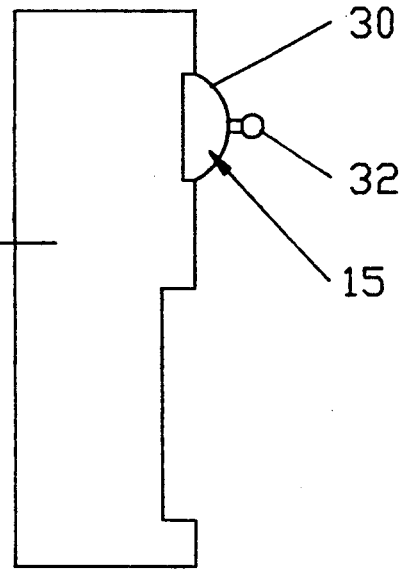
FIG. 1B is a side elevational view of the device of FIG. 1A.

As shown in FIGS. 1A to 1D, the preferred embodiment of the finger conditioning device of the invention includes a housing 10, the shape of which has no functional significance, and therefore housing 10 can be of any desired shape for aesthetic reasons. A top plate 12 and a base plate 16 are attached in any suitable manner to the top and bottom, respectively, of the housing 10. The leading part, indicated generally by the reference numeral 15 and which forms a part of the exercise-mode control described hereinafter, is located in an opening 17 in the upper front portion of the housing 10.

Frame Structure

Figures 2A, 2B, 2C:
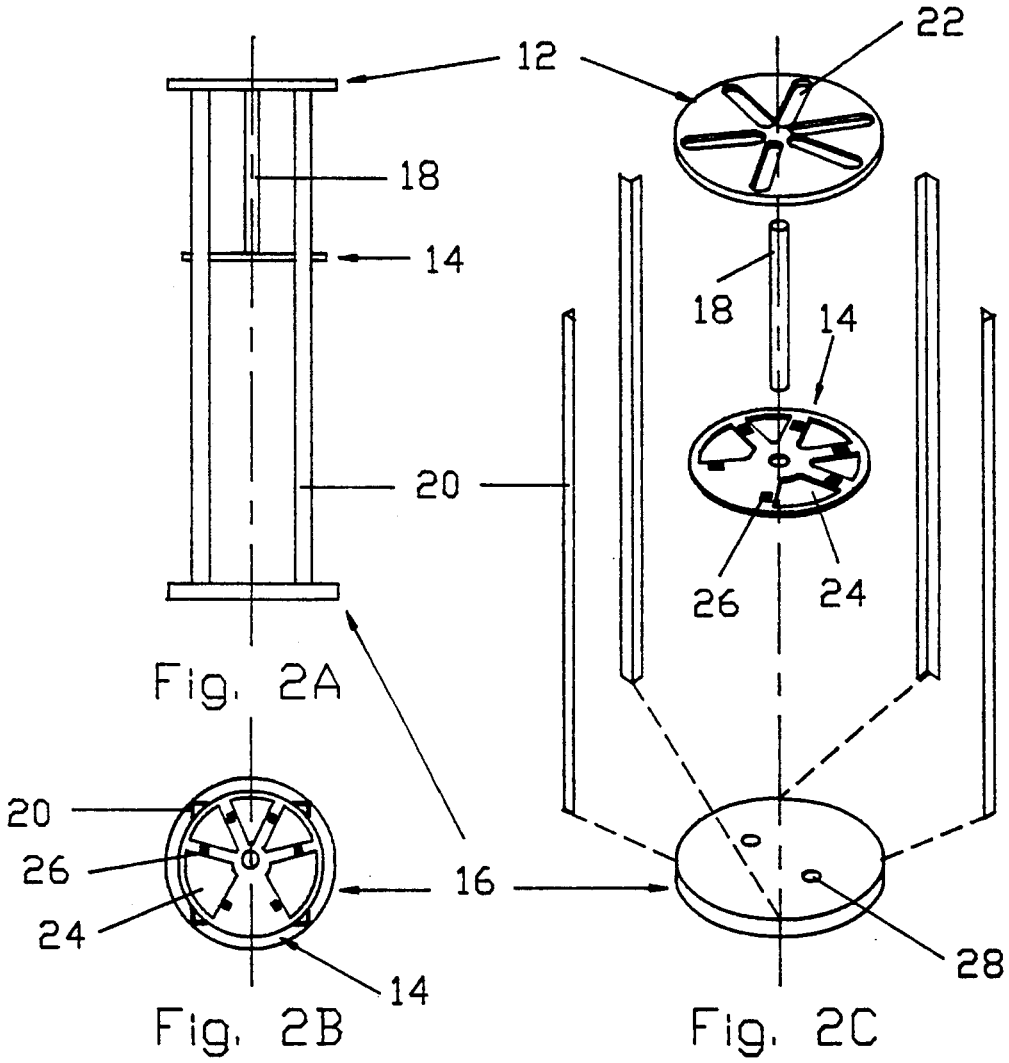
FIG. 2A illustrates the frame structure of the device of the invention.
FIG. 2B is a top or plan view of the structure of FIG. 2A with the top plate removed.
FIG. 2C is an exploded view of the frame structure.

Referring to FIGS. 2A to 2C, the frame structure includes top plate 12, a connecting plate 14, and base plate 16. A central shaft 18 extends between top plate 12 and connecting plate 14, and the ends of the central shaft 18 are attached to the bottom center of the top plate 12 and the top center of the connecting plate 14. Four angle irons 20, with upper ends fixed to the bottom of the top plate 12 and lower ends fixed to the top of the base plate 16, serve to maintain the top plate 12 and connecting plate 14 in horizontal positions and indirectly maintain the vertical alignment of the central shaft 18.

Figure 1C:
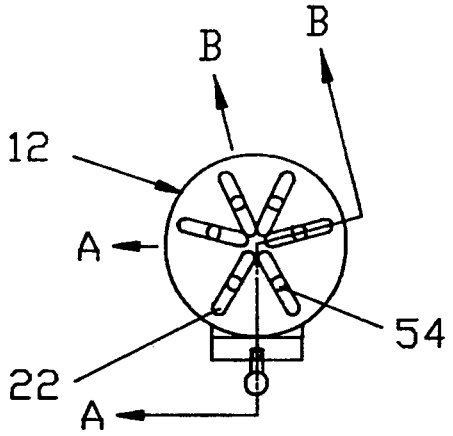
FIG. 1C is a top or plan view of the device of FIGS. 1A.
Figure 1D:
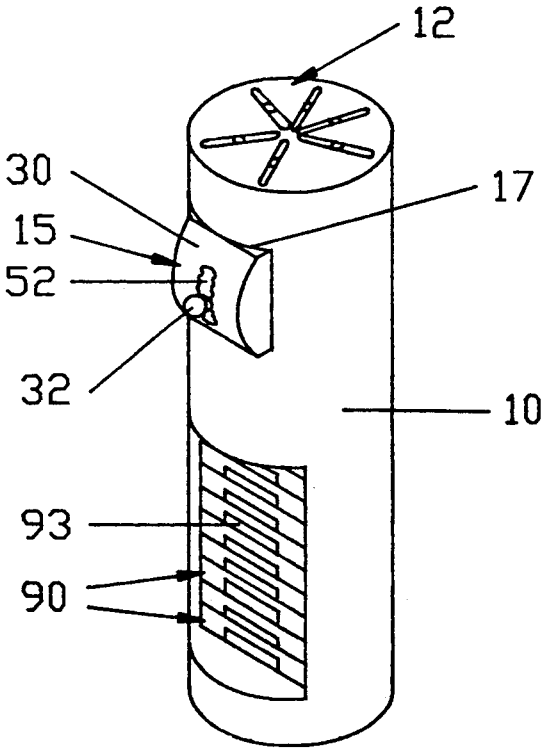
FIG. 1D is a perspective view of the device of FIGS. 1A, 1B and 1C.
Figure 4A:
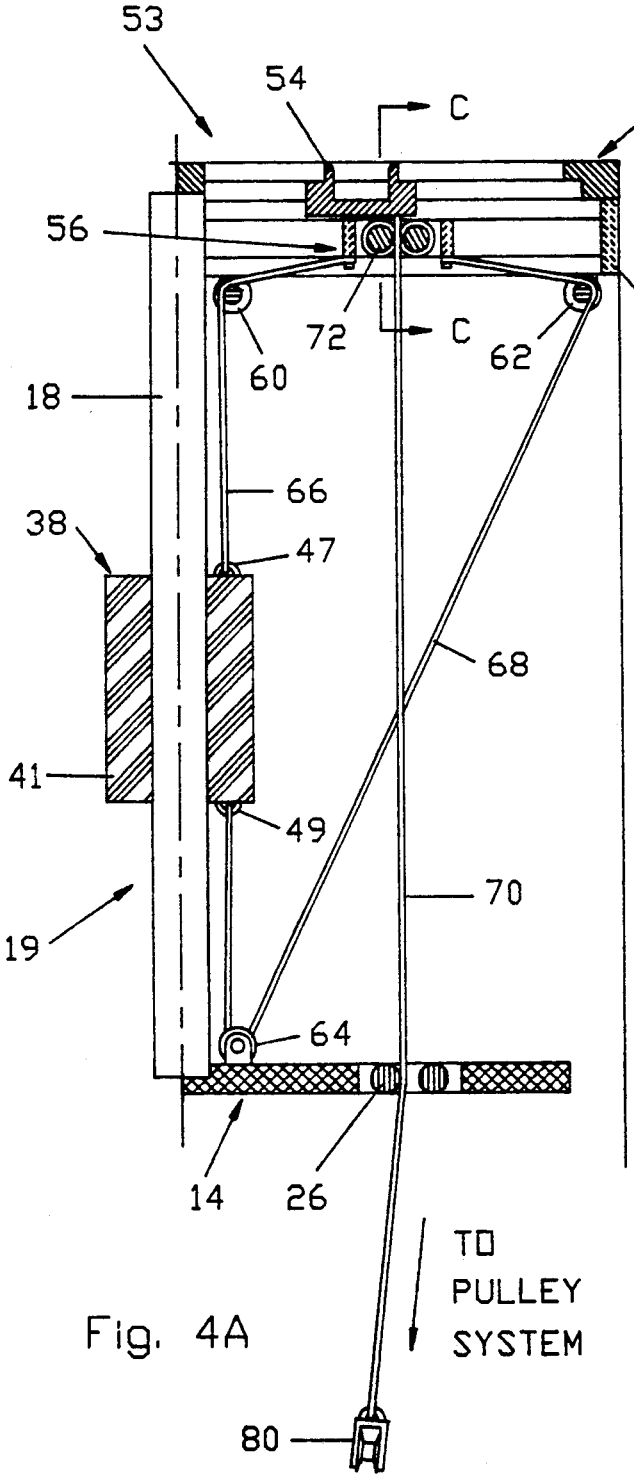
FIG. 4A is a sectional view taken on the line B—B of FIG. 1C.
Figure 4B:
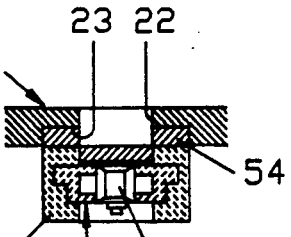
FIG. 4B is a sectional view taken on the line C—C of FIG. 4A.
Figure 4C:
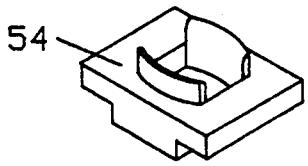
FIG. 4C is a perspective view of the finger rest component of the device of the invention.
Figure 4D:
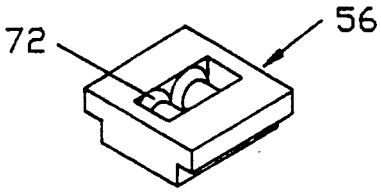
FIG. 4D is a perspective view of the sliding stop component of the invention.

As illustrated in FIGS. 1C and 2C, the top plate 12 of the preferred embodiment has six slots 22. The lower half 23 of each slot 22 is wider than the top half, as best seen in FIG. 4B. The purpose of such design will be explained hereinafter. The center lines of these slots 22 are the paths of the fingertips during exercise.

The connecting plate 14, which is attached to the angle irons 20, has five empty sectors 24. Six roller assemblies 26, located directly under and aligned with the slots 22 of the top plate 12, are positioned on connecting plate 14 between the empty sectors 24. The base plate 16 is the lowest part of the device on which other parts are supported. Base plate 16 has two cylindrical recesses 28 which receive guiding rods 94 (see FIG. 6).

Exercise-mode Control

As the name implies, the exercise-mode control portion of the device of the invention is the unit that controls the type of finger exercise performed (i.e., flexion or extension), and it includes a leading part 15 (shown in FIG. 3) and a trailing part 19 shown in FIGS. 4A to 4E. The meanings of the terms 'leading' and 'trailing' will become evident as the components of the exercise-mode control unit are described in detail.

Figure 3:
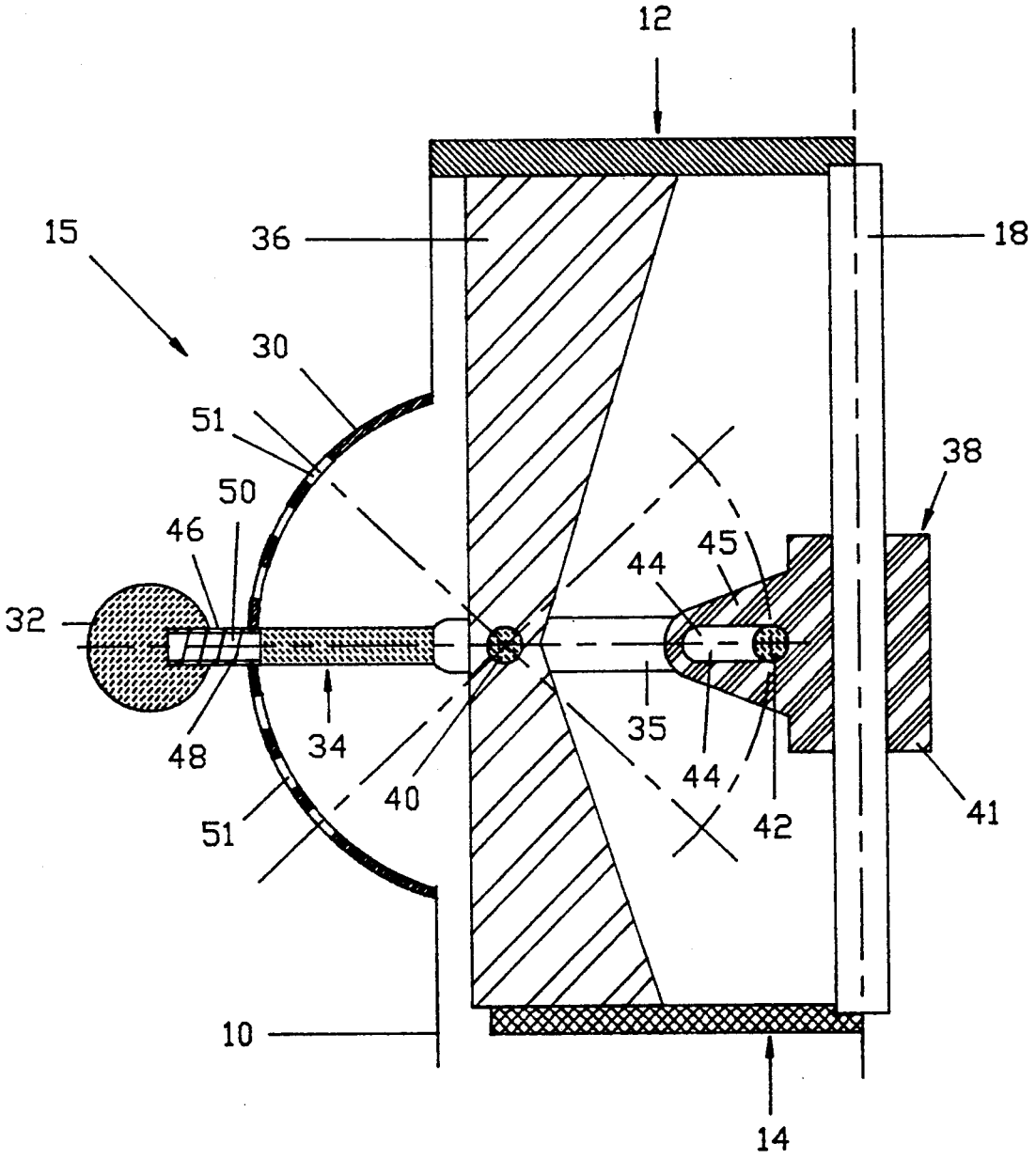
FIG. 3 is a sectional view taken on the line A—A of FIG. 1C, and showing the exercise-mode control of the device.

Referring to FIG. 3, the components of the leading part 15 are located behind a front panel 30 from which extends a knob 32 connected to a lever arm 34 that extends inwardly. The leading part 15 also includes a lever support 36, a shell 46, a spring assembly 48, and a rod slide 38. The inner end of lever arm 34 is bifurcated and has two legs 35 connected at their open ends by end pin 42, which extends through a slot 44 in the rod slide 38. The lever support 36 is a plate positioned vertically and attached to the underside of the top plate 12 at its upper end and to the top of the connecting plate 14 at its lower end. Lever support 36 has a circular hole in the mid-portion which receives a pivot pin 40 pivotally connecting the lever arm 34 to the support 36. The pivot pin 40, which acts as the center of rotation of the lever arm 34, extends through the two legs 35 of lever arm 34 near the point of bifurcation.

The outer end of lever arm 34 is of reduced diameter to form an integral, inner shaft 50 that receives the cylindrical shell 46. the knob 32 is connected to the cylindrical shell 46, and spring assembly 48 biases the shell 46 against the shoulder formed on the lever arm 34 by the inner shaft 56. Thus, when the knob 32 is pulled outwardly against the bias of spring assembly 48, part of the inner shaft 50 of the lever arm 34 is exposed and free to slide along in a slot 52 formed in the front panel 30 as shown in FIG. 1A. Notches 51 are formed at spaced intervals along slot 52 so that when the knob 32 is released, the shell 46 will engage in a selected one of the notches 51 and lock the lever arm 34 in a selected position.

Figure 4E:
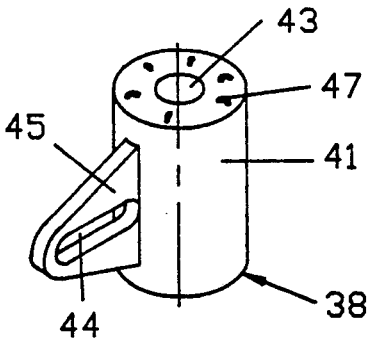
FIG. 4E is a perspective view of the rod slide component of the invention.

The rod slide 38 shown in FIG. 4E is a common component of the leading part 15 and the trailing part !9 that comprise the exercise-mode control unit. The body 41 of the rod slide 38 is cylindrical in shape and has a bore 43 which receives the central shaft 18. A vertically-extending triangular-shaped plate 45, which has a short slot 44, is fixed to the outside of the body 41. Hooks 47 and 49 extend from the top and bottom surfaces of the body 41. Hooks 47 and 49 provide for attachment of cables 66 and 68 of the trailing part 19 of the exercise-mode control unit (see FIG. 4A).

The trailing part 19 of the exercise-mode control unit includes six identical finger units 53, one located directly below each of the slots 22 of the top plate 12. One of the finger units 53 is illustrated in FIG. 4A. Each unit 53 includes a finger rest 54, a sliding stop 56, a rail 58, three pulleys 60, 62, and 64, and three cables 66, 68, and 70. The rail 58 is attached to the underside of the top plate 12 and the upper part of the central shaft 18. The rail 58 and lower half 23 of slot 22 of the top plate 12 provide the grooves that define the sliding movement of the finger rest 54 and sliding stop 56 (See FIG. 4B).

The sliding stop 56 on opposite ends is connected to two cables 66 and 68 which tend to pull the stop 56 in opposite directions. One of the cables 66 rides on the inner pulley 60 that is fixed to the bottom of the rail 58 and fastens to a hook 47 on top of the rod slide 38. The other cable 68 rides on the outer pulley 62, a second pulley 64 that is fixed to the connecting plate 14, and is fastened to a hook 49 on the bottom of the rod slide 38. Therefore, the sliding stop 56 and -rod slide 38, joined by two cables 66 and 68, form a closed loop.

The exercise-mode control unit is connected to the pulley system illustrated in FIGS. 5A and 5B as follows. A cable 70 has one end attached to the bottom of the finger rest 54. Cable 70 then passes through two sets of rollers 72 and 26 and is attached at its other end to a floating pulley 80 that forms a part of the pulley system.

Pulley System

Figure 5A:
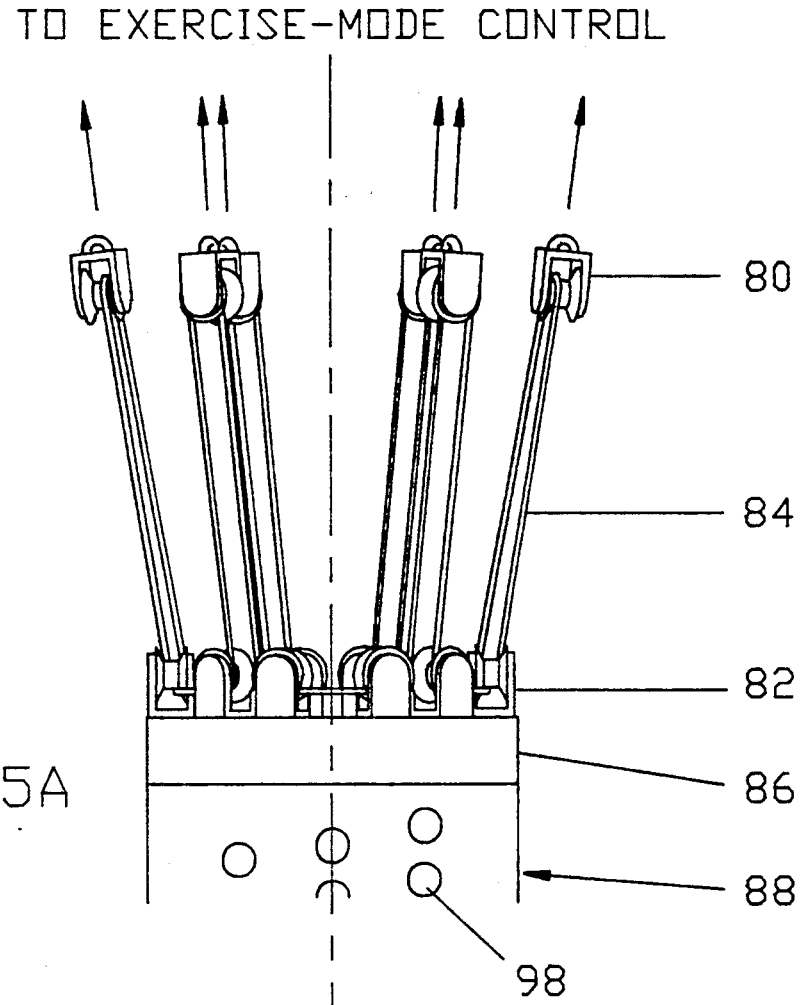
FIG. 5A is an elevational view of the pulley system of the device of the invention.
Figure 5B:
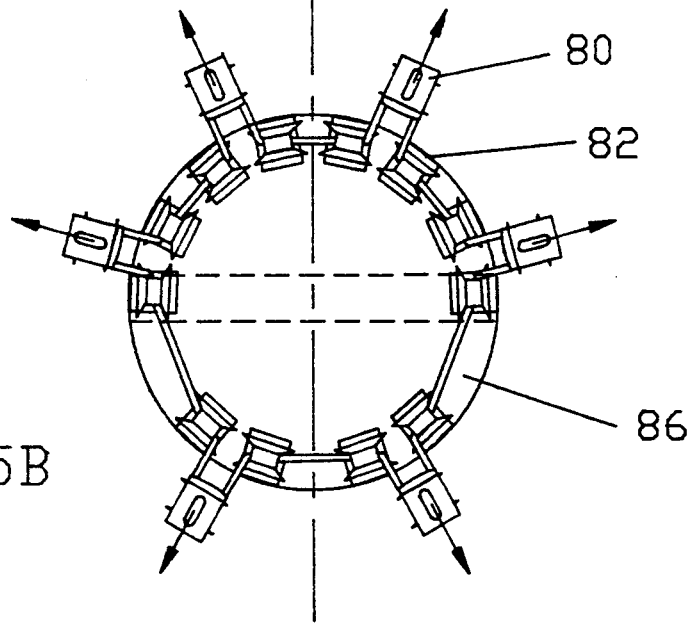
FIG. 5B is a top plan view of the pulley system.

The pulley system illustrated in FIGS. 5A and 5B includes two sets of pulleys 80 and 82 and a cable loop 84. As previously described, the six floating pulleys 80 are connected to the cables 70 from the exercise-mode control unit. Twelve fixed pulleys 82 are attached to the top of a disk 86 that is a part of the weight unit shown in FIG. 6. A cable loop 84 loops around two sets of pulleys 80 and 82 as shown in FIG. 5A and 5B. The pulleys and cables are arranged such that the portions of loop cables 84 located between respective ones of the floating pulleys 80 and the corresponding adjacent fixed pulleys 82 have about the same inclination with respect to the horizon. The major functions of the pulley system are to equally distribute the load on finger rests 54 and to maintain the balance of the disk 86 even when not all floating pulleys 80 are being pulled upward at the same time.

Weight Unit

Figure 6:
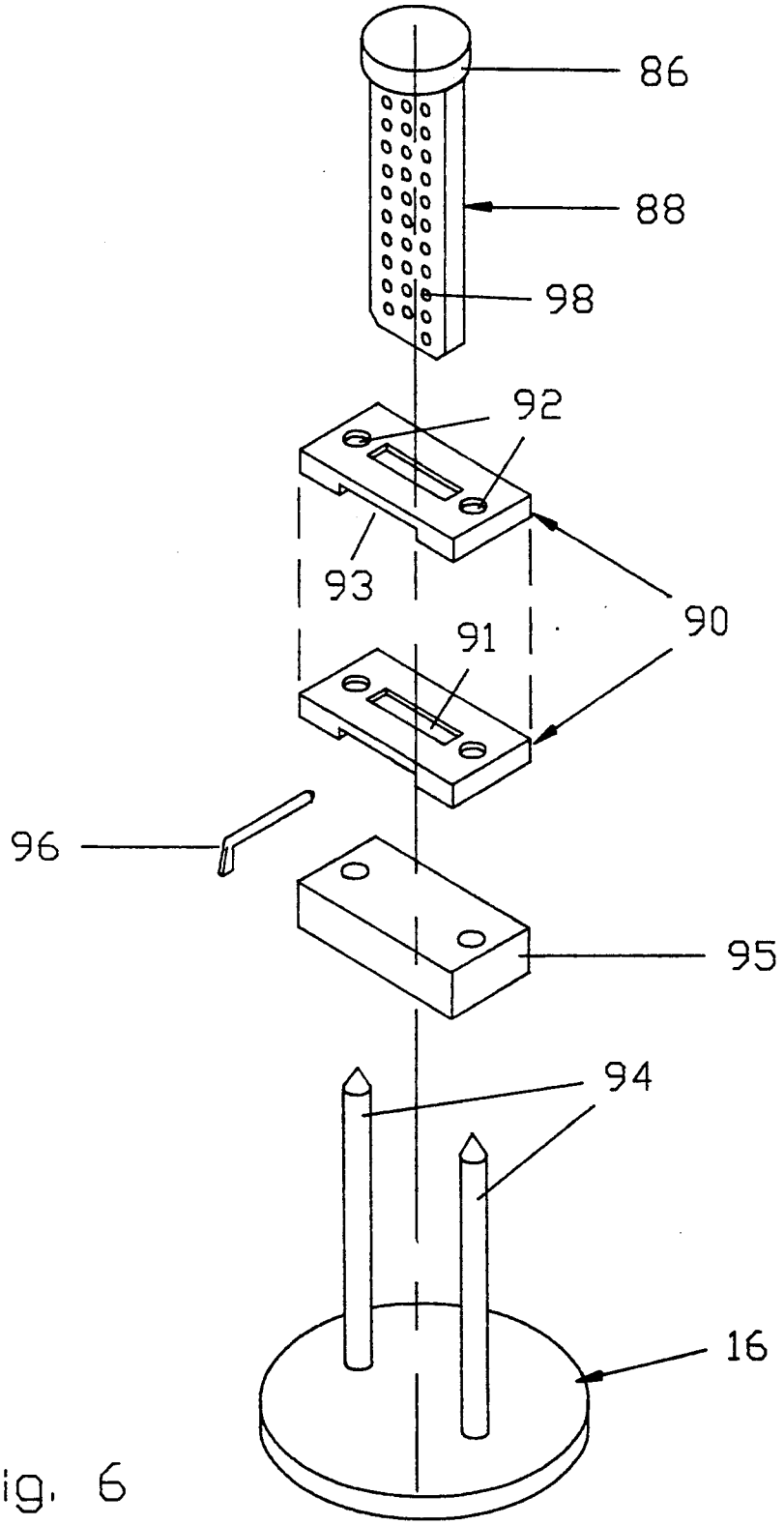
FIG. 6 is a perspective, exploded view of the weight unit portion of the device of the invention.

Referring to FIG. 6, the components of the weight unit include a disk 86, a load bar 88, a stack of weight plates 90, a cushion 95, and a pair of guiding rods 94. The load bar 88 is fixed to the underside of the disk 86 and has several columns and rows of holes 98. Each weight plate 90 has a rectangular hole 91 in the middle to house the load bar 88 and two circular holes 92 on each side of hole 91 to receive the guiding rods 94 that extend upwardly from the base plate 16. A notch 93 is formed at the mid-bottom half in the front of the weight plate 90 to allow a pin 96 to be inserted into one of the holes 98. The arrangement of the holes 98 is such that when the load bar 88 is at a hanging position (i.e., the disk 86 not resting on the top of the weight stack), at least one column of holes 98 will match the notches 93 formed in the front edges of the weight plates 90. The size of each hole 98 is just large enough to accommodate a pin 96, which is designed to pass through one of the notches 93 of a weight plate 90 and enter one of the holes 98 in the load bar 88. The cushion 95 is made of less rigid material and serves as shock absorber. The function of the guiding rods 94 is to maintain the vertical alignment of the weight unit.

Operation of the Preferred Embodiment

In order to perform the finger flexion exercise, the user first pulls the knob 32 away from the front panel 30 and moves the knob 32 downwardly. This will cause the rod slide 38 to move upwardly along the central shaft 18, and since the sliding stops 56 are connected by cables 66 and 68 to the rod slide 38, the sliding stops 56 will move outwardly and draw the finger rests 54 away from the center of the top plate 12. When the user releases the knob 32 and the knob 32 retracts into one of the notches 51 in the slot 52 of the front panel 30, the positions of the rod slide 38 and sliding stops 56 are locked. The user can now place the fingers in the finger rests 54. The flexion exercise is completed by moving the fingertips toward the center of the top plate !2. When the finger rests 54 are being pulled away from the sliding stops 56, the cables 70 pull the floating pulleys 80 upwardly. Consequently, the disk 86 and load bar 88 are pulled upwardly. If a pin 96 is engaged in one of the holes 98 in the load bar 88, the weight plates 90 that are above the pin 96 will also move upward at the same time. The resistance of the flexion exercise depends on the number of weight plates 90 being moved, and thus the amount of resistance is controlled by inserting the pin 96 into a hole 98 at the desired level.

The procedure for extension exercise is the opposite of the flexion exercise. The user moves the knob 32 upwardly to cause the converging of finger rests 54. After selecting the amount of resistance by inserting the pin 96 into a hole 98 in the load bar 88, the user places the fingers into the finger rests 54 and moves the fingertips away from the center of the top plate 12.

Instead of exercising all five fingers at the same time, the user can work on selected fingers. This feature is very useful for the rehabilitation of injured fingers and for the isolated training of some specific fingers for special purposes.

The present invention is a heavy duty type exercise machine that is designed to be used in those settings like schools, fitness and health clubs, and rehabilitation centers. The preferred embodiment can be used by athletes to strengthen their fingers; by musicians to improve the dexterity of their fingers; by fitness pursuers to maintain the muscular strength of their fingers; and by elderly and patients to recover the functional capacity of their hands.

Having thus described the invention in connection with the preferred embodiment thereof, it will be evident to those skilled in the art that various revisions and modifications can be made to the preferred embodiment described herein without departing from the spirit and scope of the invention. It is my intention, however, that all such revisions and modifications that are obvious to those skilled in the art will be included within the scope of the following claims.

What is claimed is:

1. A device for exercising and conditioning the fingers of a user, said device comprising moveable finger rests, one such rest for each finger and each rest moveable independently of the other finger rests, guide means to guide movement of the finger rests along predetermined horizontal paths located in substantially the same plane, the guide means providing for movement of the finger rests inwardly or outwardly in said plane from a central location, resistance means to apply force to each finger rest so as to resist movement of each finger rest in either the inwardly or outwardly direction along the predetermined paths, movement of a finger rest by the finger of a user in an outwardly direction providing for extension of the fingers while movement of a finger rest in an inwardly direction providing for flexion of the fingers, mode control means to provide for positioning of the finger rests in a selected position for either flexion or extension exercises, and control means providing for selection by the user of the amount of resistance applied by the resistance means.

2. The device of claim 1 in which the guide means includes a guide member having a plurality of slots extending radially outwardly from the central location and which define the paths for movement of the finger rests, the finger rests being movable in said slots against the resistance of the resistance means.

3. The device of claim 2 in which a sliding stop is combined with each finger rest, each finger rest being carried by the sliding stop but movable relative to the sliding stop against the resistance of the resistance means, the sliding stops being operatively connected to the mode selection mean for movement to a selection position so as to provide for positioning of the finger rests for either extension or flexion exercises.

4. The device of claim 3 in which the resistance means includes a plurality of weights and means to connect the weights to the finger rests to resist movement of the finger rests when moved in either the inwardly or outwardly direction.

5. The device of claim 4 in which the control means includes a pin for selecting the desired number of weights that will be connected to the carrier means.

6. The device of claim 1 in which the mode control means includes a moveable rod slide operatively connected to all the finger rests to position the finger rests in a selected position for either flexion or extension exercises, and a user operated control lever is operatively connected to the rod slide to move the rod slide to either the extension or flexion mode and thus move the finger rests to the proper position for the selected mode.

* * * * *